US009528292B1

(12) United States Patent
Lovley, II et al.

(10) Patent No.: US 9,528,292 B1
(45) Date of Patent: Dec. 27, 2016

(54) CANOPY WITH OVERHANG

(71) Applicant: BRAVO SPORTS, Santa Fe Springs, CA (US)

(72) Inventors: Jack B. Lovley, II, Lake Forest, CA (US); Mark Groenhuyzen, Huntington Beach, CA (US); Joseph C. Klingl, Los Angeles, CA (US)

(73) Assignee: Bravo Sports, Santa Fe Springs, CA (US)

( * ) Notice: Subject to any disclaimer, the term of this patent is extended or adjusted under 35 U.S.C. 154(b) by 0 days.

(21) Appl. No.: 14/455,694

(22) Filed: Aug. 8, 2014

Related U.S. Application Data

(60) Provisional application No. 61/988,799, filed on May 5, 2014, provisional application No. 61/864,489, filed on Aug. 9, 2013, provisional application No. 61/864,470, filed on Aug. 9, 2013.

(51) Int. Cl.
*E04H 15/32* (2006.01)
*E04H 15/50* (2006.01)
*E04H 15/48* (2006.01)

(52) U.S. Cl.
CPC ..... *E04H 15/48* (2013.01); *E04H 15/32* (2013.01); *E04H 15/50* (2013.01)

(58) Field of Classification Search
CPC ..... E04H 15/48; E04H 15/50; E04H 15/58; E04H 15/34; A45B 9/04
USPC ..... 135/117, 145–147, 155, 161, 119, 77
See application file for complete search history.

(56) References Cited

U.S. PATENT DOCUMENTS

| | | | |
|---|---|---|---|
| 33,398 | A | 10/1861 | Miller |
| 574,235 | A | 12/1896 | Bennitt |
| 900,572 | A | 10/1908 | Morton |
| 914,774 | A | 3/1909 | Zimmerman |
| 1,024,176 | A | 4/1912 | Boyens |
| 1,075,372 | A | 10/1913 | Overshiner |

(Continued)

FOREIGN PATENT DOCUMENTS

| | | |
|---|---|---|
| AU | A 15170/92 | 12/1993 |
| CH | 635 393 | 3/1983 |

(Continued)

OTHER PUBLICATIONS

U.S. Appl. No. 60/467,698, May 1, 2003, Churchill.

*Primary Examiner* — Winnie Yip
(74) *Attorney, Agent, or Firm* — Knobbe, Martens, Olson & Bear, LLP

(57) ABSTRACT

A canopy includes a frame assembly having a perimeter frame portion, a central frame portion and multiple legs. The frame assembly also includes one or more overhang frame portions, each of which can include a main overhang frame member and a strut. Each overhang frame portion can extend diagonally from the associated corner of the frame assembly. The canopy also includes a cover, which can be a fabric or flexible material cover capable of collapsing along with the preferably collapsible frame assembly. The cover can include a central portion located substantially within an area defined by the perimeter frame portion and an overhang portion, which surrounds or circumscribes the central portion of the cover. The overhang frame portions can support an overhang portion of the cover, which extends outwardly from the perimeter frame portion. A support of the canopy can be configured to leave a logo imprint on the ground.

17 Claims, 9 Drawing Sheets

(56) References Cited

U.S. PATENT DOCUMENTS 1,238,646 A 8/1917 Dennis
1,256,902 A 2/1918 Howe
1,334,048 A 3/1920 Powers
1,341,689 A 6/1920 Walmsley
1,429,043 A 9/1922 Martin
1,443,921 A 1/1923 Mackenzie
1,575,902 A 3/1926 Dial
1,593,431 A 7/1926 Buie
1,605,679 A 11/1926 McGrail
1,639,074 A 8/1927 Blackwood
1,666,757 A 4/1928 Snyder
1,763,455 A 6/1930 Bruijn
1,789,090 A 1/1931 Wawrunek
1,846,011 A 2/1932 Adams
1,915,504 A 6/1933 Stokby
2,001,252 A 5/1935 Johnson
2,070,484 A 2/1937 Jones
2,137,427 A 11/1938 Thomson
2,151,908 A 3/1939 Gottlieb
2,166,832 A 7/1939 Wenker
2,243,984 A 6/1941 Singewald
2,265,479 A 12/1941 Goodman
2,429,763 A 10/1947 Lindabury
2,490,367 A 12/1949 Maddocks
2,545,968 A 3/1951 Newstead
2,561,886 A 7/1951 Rikelman
2,571,382 A 10/1951 Raven
2,658,562 A 11/1953 Androsiglio
D171,176 S 12/1953 Yellen
2,689,603 A 9/1954 Smith
2,712,349 A 7/1955 Voir
2,729,276 A 1/1956 Volney
2,747,653 A 5/1956 Obradovich
D180,210 S 4/1957 Uretsky
2,819,776 A 1/1958 Balsam
2,849,249 A 8/1958 Fridolph
2,926,724 A 3/1960 Rittenberg
2,989,968 A 6/1961 Gunter
3,007,735 A 11/1961 Cohn
3,034,523 A 5/1962 De Shano
3,085,586 A 4/1963 McDonough
3,092,224 A 6/1963 O'Neil
3,151,909 A 10/1964 Gerdetz
3,179,465 A 4/1965 Roberts
3,214,217 A 10/1965 Jente
3,243,230 A 3/1966 Otto
3,307,758 A 3/1967 Platt
3,309,134 A 3/1967 Roberts
3,333,595 A 8/1967 Bannister
3,339,566 A 9/1967 Bowden
3,371,671 A 3/1968 Kirkham
3,404,915 A 10/1968 Filho
3,450,432 A 6/1969 Minsker
3,544,157 A 12/1970 Muller
3,580,633 A 5/1971 Du Priest
3,621,857 A 11/1971 May et al.
3,637,086 A 1/1972 Klein
3,879,086 A 4/1975 Moceri
3,918,109 A 11/1975 Barraclough
3,931,918 A 1/1976 Smith et al.
3,935,874 A 2/1976 Cohen
3,947,903 A 4/1976 Menke
4,029,279 A 6/1977 Nakatani
4,030,748 A 6/1977 Brock
4,047,752 A 9/1977 Rohr
4,063,318 A 12/1977 Nicholson
4,082,102 A 4/1978 Heuer
4,123,095 A 10/1978 Stehlin
4,174,900 A 11/1979 Ina
4,201,416 A 5/1980 Vanderminden
4,248,255 A 2/1981 Arrowsmith
4,251,106 A 2/1981 Gilbert
D261,332 S 10/1981 Rohr
4,293,162 A 10/1981 Pap et al.
4,295,481 A 10/1981 Gee
4,300,798 A 11/1981 Musgrove et al.
4,445,590 A 5/1984 Ihrman
4,487,345 A 12/1984 Pierce et al.
4,497,092 A 2/1985 Hoshino
4,530,451 A 7/1985 Hamilton
4,573,717 A 3/1986 Peacock
4,596,484 A 6/1986 Nakatani
4,635,667 A 1/1987 Harn
4,639,036 A 1/1987 Nichols
4,639,958 A 2/1987 Lerner
4,641,676 A 2/1987 Lynch
4,641,883 A 2/1987 Kato
D289,473 S 4/1987 Myers
4,687,248 A 8/1987 Ross et al.
4,687,249 A 8/1987 Mills
4,736,825 A 4/1988 Belfi
4,744,690 A 5/1988 Hsieh
4,761,092 A 8/1988 Nakatani
4,773,574 A 9/1988 Burgard
4,779,635 A 10/1988 Lynch
4,795,068 A 1/1989 Blean
4,796,734 A 1/1989 Distasic
4,809,724 A 3/1989 Fuser
4,810,029 A 3/1989 Kaladis et al.
4,824,171 A 4/1989 Hollingsworth
4,858,990 A 8/1989 Combs-Rose et al.
4,865,381 A 9/1989 Van Rogue
4,870,984 A 10/1989 Roth
4,885,812 A 12/1989 Linder
4,889,383 A 12/1989 Jones
4,915,120 A 4/1990 Ziolkowski
4,924,896 A 5/1990 Carter
4,932,622 A 6/1990 Hayakawa
4,949,929 A 8/1990 Kesselman et al.
D310,605 S 9/1990 Kwon
4,971,089 A 11/1990 Braman
4,972,981 A 11/1990 Gex
5,000,210 A 3/1991 Worthington, Jr.
5,013,085 A 5/1991 Craig
5,022,420 A 6/1991 Brim
5,035,253 A 7/1991 Bortles
5,042,874 A 8/1991 Williams
5,080,432 A 1/1992 Connell
5,096,257 A 3/1992 Clark
5,102,190 A 4/1992 Akin et al.
5,135,281 A 8/1992 Pappalardo
5,139,308 A 8/1992 Ziman
5,154,449 A 10/1992 Suei-Long
5,154,473 A 10/1992 Joranco
5,203,363 A 4/1993 Kidwell et al.
5,205,308 A 4/1993 Kendall et al.
5,209,381 A 5/1993 Jay
5,240,020 A 8/1993 Byers
5,244,001 A 9/1993 Lynch
5,244,250 A 9/1993 Nordmeyer
D339,937 S 10/1993 Ryan
5,289,958 A 3/1994 Jay
5,299,337 A 4/1994 Venza
5,303,975 A 4/1994 Asato
5,320,405 A 6/1994 Foster et al.
5,350,215 A 9/1994 DeMars
5,362,130 A 11/1994 Hoffman
5,387,048 A 2/1995 Kuo
5,388,821 A 2/1995 Blackburn
5,395,157 A 3/1995 Rollo et al.
5,421,356 A 6/1995 Lynch
D360,535 S 7/1995 Sjoberg
5,433,502 A 7/1995 Condorodis et al.
5,433,552 A 7/1995 Thyu
5,441,067 A 8/1995 James et al.
5,449,014 A 9/1995 Yan-ho
5,485,863 A 1/1996 Carter
5,490,533 A 2/1996 Carter
5,511,572 A 4/1996 Carter
5,516,193 A 5/1996 Simpson
5,533,654 A 7/1996 Holty et al.
5,538,318 A 7/1996 MacLean
5,538,319 A 7/1996 DiMurro
5,544,793 A 8/1996 Harrop

(56) References Cited

U.S. PATENT DOCUMENTS 5,547,246 A 8/1996 Lambert
5,551,110 A 9/1996 Armstrong et al.
5,551,669 A 9/1996 Reinklou
5,564,452 A 10/1996 Kitchen
5,579,797 A 12/1996 Rogers
5,582,458 A 12/1996 Wildt
5,593,205 A 1/1997 Vanderminden, Sr. et al.
5,593,239 A 1/1997 Sallee
5,597,101 A 1/1997 Barber et al.
5,626,271 A 5/1997 Messey et al.
5,632,292 A 5/1997 Carter
5,634,483 A 6/1997 Gwin
5,638,851 A 6/1997 Baldwin
D380,306 S 7/1997 Lin
D382,126 S 8/1997 Lee
D382,414 S 8/1997 Lee
5,695,100 A 12/1997 O'Brien
5,695,296 A 12/1997 Miura
5,718,473 A 2/1998 Lynch, Jr.
5,722,717 A 3/1998 Rettenberger
5,794,640 A 8/1998 Jang
5,797,650 A 8/1998 Gonzalez, Jr. et al.
5,813,425 A 9/1998 Carter
5,819,999 A 10/1998 Tennant
5,833,310 A 11/1998 Labelle
5,873,625 A 2/1999 Uchtman
5,921,258 A 7/1999 Francois
5,934,301 A 8/1999 Carter
5,951,103 A 9/1999 Barnhill
5,961,178 A 10/1999 Hodson
5,967,601 A 10/1999 Gillins
5,975,626 A 11/1999 Aycock
5,984,406 A 11/1999 Lee
6,000,175 A 12/1999 Gale et al.
6,035,877 A 3/2000 Losi, Jr. et al.
6,036,262 A 3/2000 Shahid
6,045,177 A 4/2000 Grace
6,070,604 A 6/2000 Carter
6,082,813 A 7/2000 Chen
6,089,247 A 7/2000 Price
6,095,172 A 8/2000 Trapp et al.
6,112,757 A 9/2000 Tseng
6,129,102 A 10/2000 Carter
6,131,593 A * 10/2000 Greene et al. ..... 135/77
6,142,699 A 11/2000 Pao
6,148,835 A 11/2000 Rhee
6,152,156 A 11/2000 Tung
6,164,726 A 12/2000 Reeves et al.
6,179,514 B1 1/2001 Cheng
6,206,463 B1 3/2001 Whigham
6,230,729 B1 5/2001 Carter
6,241,311 B1 6/2001 Zheng
6,250,712 B1 6/2001 Livington et al.
6,263,895 B1 7/2001 Bang
6,264,271 B1 7/2001 Munn et al.
6,276,382 B1 8/2001 Bindschatel et al.
6,283,136 B1 * 9/2001 Chen ..... 135/144
6,296,002 B1 10/2001 Tashchyan
6,328,131 B1 12/2001 Backus
6,354,044 B1 3/2002 Lagace, Jr.
6,363,956 B2 4/2002 Carter
6,371,553 B1 4/2002 Tang
6,405,742 B1 6/2002 Driscoll
6,412,507 B1 7/2002 Carter
6,471,289 B2 10/2002 Aguilar
6,478,039 B2 11/2002 Suh
6,508,262 B1 1/2003 Takayama
6,516,821 B1 2/2003 Uemura
6,520,196 B2 2/2003 Carter
6,520,574 B1 2/2003 Huang
6,536,723 B1 3/2003 Nakatani
6,547,324 B1 4/2003 Ammann, Jr.
6,551,226 B1 4/2003 Webber et al.
6,575,656 B2 6/2003 Suh
6,591,849 B1 7/2003 Swetish et al.
6,655,736 B1 12/2003 Arenas
6,672,631 B1 1/2004 Weinhold
6,676,092 B2 1/2004 Tsai
D487,297 S 3/2004 Tyler et al.
6,698,827 B2 3/2004 Le Gette et al.
6,712,083 B2 3/2004 Carter
6,718,995 B2 4/2004 Dotterweich
D494,769 S 8/2004 Vigneaud
6,779,538 B2 8/2004 Morgante et al.
6,789,557 B1 9/2004 Wahl, Jr.
6,823,883 B1 11/2004 Sears
6,824,210 B2 11/2004 Zheng
6,837,642 B1 1/2005 Lin
6,845,780 B2 1/2005 Bishirjian
6,899,383 B2 5/2005 Hwang
6,908,249 B2 6/2005 Tomm
6,913,231 B2 7/2005 Speggiorin
6,926,355 B2 8/2005 Le Gette et al.
6,929,017 B2 8/2005 Byun
6,979,056 B1 12/2005 Goldszer
6,981,510 B2 1/2006 Carter
7,040,832 B2 5/2006 Hsieh
7,044,145 B2 5/2006 Bouchard
7,044,146 B2 5/2006 Losi, Jr.
7,048,333 B2 5/2006 Martinez
D522,605 S 6/2006 Bishirjian
7,066,676 B2 6/2006 Tsai
7,097,380 B2 8/2006 Lee
7,118,172 B1 10/2006 Pattison-Sheets
7,168,759 B2 1/2007 Gallegos Geier
7,198,324 B2 4/2007 Le Gette et al.
7,231,954 B2 6/2007 Green
7,240,685 B2 7/2007 Seo
7,240,687 B2 7/2007 Carter
7,243,990 B1 7/2007 Wahl
7,252,108 B2 8/2007 Carter
7,261,263 B2 8/2007 Baker et al.
7,293,934 B1 11/2007 Huang
7,296,584 B2 11/2007 Goldwitz
7,299,812 B2 11/2007 Carter
7,299,813 B2 11/2007 Ochi
7,302,745 B2 12/2007 Stahle
7,302,957 B2 12/2007 Ross
7,311,355 B2 12/2007 Fargason, III
7,316,450 B2 1/2008 Ayers et al.
7,350,532 B2 4/2008 Wu
7,373,708 B2 5/2008 Stahle et al.
7,374,238 B2 5/2008 Lingwall
7,380,563 B2 6/2008 Seo
7,395,830 B2 7/2008 Seo
7,396,073 B2 7/2008 Zheng
7,409,963 B2 8/2008 Mallookis et al.
7,422,009 B2 9/2008 Rummel et al.
7,422,026 B2 9/2008 Kim
7,427,101 B1 9/2008 Zernov
7,428,908 B2 9/2008 Seo
7,431,389 B2 10/2008 Reeb et al.
7,481,236 B2 1/2009 Carter
7,494,296 B2 2/2009 Stahle
RE40,657 E 3/2009 Suh
7,527,331 B2 5/2009 Fargason, III
7,568,307 B1 8/2009 Zimhoni et al.
7,637,276 B2 12/2009 Mallookis et al.
D612,624 S 3/2010 Lovley et al.
7,673,643 B2 3/2010 Seo
7,703,469 B2 4/2010 Danziger
7,735,504 B2 6/2010 Carter
7,753,063 B1 7/2010 Laws
7,753,064 B2 7/2010 Sy-Facunda
7,757,916 B1 7/2010 Petrie et al.
7,775,229 B2 8/2010 Sy-Facunda
7,784,480 B2 8/2010 Sy-Facunda
7,789,099 B2 9/2010 Mallookis et al.
D625,507 S 10/2010 Quinn
7,806,381 B2 10/2010 Sisk Horne et al.
7,836,907 B2 11/2010 Carter
7,849,867 B2 12/2010 Takayama
7,874,303 B2 1/2011 Xie
7,921,864 B2 4/2011 Carter

(56) References Cited

U.S. PATENT DOCUMENTS 7,922,416 B2 4/2011 Davis et al.
7,954,272 B2 6/2011 Potterfield et al.
7,967,259 B2 6/2011 Nakatani
7,975,712 B2 7/2011 Beacco
7,980,519 B2 7/2011 Chen
7,997,291 B2 8/2011 Gressette et al.
8,006,711 B2 8/2011 Pietrzak et al.
8,025,455 B2 9/2011 Huang et al.
D648,148 S 11/2011 Henry
8,074,669 B2 12/2011 Collins et al.
8,075,217 B2 12/2011 Eason
8,079,380 B2 12/2011 Engstrom et al.
8,091,962 B2 1/2012 Quinn
8,128,306 B2 3/2012 Gorza
8,162,280 B2 4/2012 Yu et al.
8,185,979 B2 5/2012 Hentschel
8,186,755 B2 5/2012 Lovley
8,191,744 B2 6/2012 Petrie et al.
8,220,477 B2 7/2012 Park
8,376,646 B2 2/2013 Melino et al.
8,408,225 B2 4/2013 Mallookis et al.
8,418,711 B2 4/2013 Park
8,590,553 B2 11/2013 Lovley et al.
8,608,118 B2 12/2013 Lai
8,616,226 B2 12/2013 Ma et al.
8,746,267 B2 6/2014 Lovley, II et al.
8,776,810 B2 7/2014 Lah et al.
D712,730 S 9/2014 Gridley
D736,884 S 8/2015 Lovley, II et al.
D737,066 S 8/2015 Lovley, II et al.
9,101,222 B2 8/2015 Minkoff
9,103,138 B2 8/2015 Lovley, II
9,175,496 B2 11/2015 Darquea
9,220,347 B2 12/2015 Lovley, II et al.
9,279,269 B2 3/2016 Lovley, II et al.
2002/0030146 A1 3/2002 Akaike
2002/0112752 A1 8/2002 Blakney
2003/0090904 A1 5/2003 Ching
2003/0164185 A1 9/2003 Price
2004/0084074 A1 5/2004 Chiu et al.
2004/0101351 A1 5/2004 Pitcher
2004/0178665 A1 9/2004 May
2004/0182430 A1 9/2004 Seo
2004/0222678 A1 11/2004 Hansen
2004/0238021 A1* 12/2004 Holub et al. ..... 135/97
2004/0255997 A1 12/2004 Seo
2004/0261828 A1 12/2004 Jang
2005/0028856 A1 2/2005 Seo
2005/0081904 A1 4/2005 Suzuki et al.
2005/0155637 A1 7/2005 Kim
2005/0178419 A1 8/2005 Tseng
2005/0178422 A1* 8/2005 Wu ..... 135/158
2005/0194030 A1 9/2005 Goldwitz
2005/0205124 A1 9/2005 Goldwitz
2005/0249545 A1 11/2005 Tsai
2006/0051159 A1 3/2006 Tsai
2006/0054207 A1 3/2006 Wootliff
2006/0062632 A1 3/2006 Jang
2006/0096631 A1 5/2006 Mallookis
2006/0144434 A1 7/2006 Chen
2006/0169311 A1 8/2006 Hwang
2006/0174929 A1* 8/2006 Tseng ..... 135/159
2006/0249192 A1 11/2006 Tsai et al.
2006/0260666 A1 11/2006 Choi
2007/0012346 A1 1/2007 Choi
2007/0018486 A1 1/2007 Ayers et al.
2007/0040422 A1 2/2007 Reeb et al.
2007/0051397 A1* 3/2007 Choi ..... 135/131
2007/0145792 A1 6/2007 Miller
2007/0181172 A1 8/2007 Harrison
2007/0204897 A1 9/2007 Habib et al.
2007/0221263 A1 9/2007 Tai
2007/0236058 A1 10/2007 Yeider
2007/0240748 A1 10/2007 Bae
2008/0035194 A1 2/2008 Goldwitz
2008/0087313 A1 4/2008 Jang
2008/0121260 A1 5/2008 Stephens et al.
2009/0071521 A1 3/2009 Sy-Facunda
2009/0087251 A1 4/2009 Chen
2009/0218856 A1 9/2009 Sykes et al.
2009/0309394 A1 12/2009 Chen
2010/0064739 A1 3/2010 Lu
2010/0101617 A1 4/2010 Stehly
2010/0102600 A1 4/2010 Lovley, II
2010/0269877 A1 10/2010 Sy-Facunda
2010/0275962 A1* 11/2010 Park et al. ..... 135/122
2011/0023924 A1 2/2011 Park
2011/0023925 A1 2/2011 Johnson et al.
2011/0073148 A1 3/2011 Choi
2011/0181078 A1 7/2011 Kelly
2011/0192436 A1 8/2011 Gridley
2011/0240078 A1 10/2011 Lenhart et al.
2011/0259381 A1* 10/2011 Adams ..... 135/82
2011/0274481 A1 11/2011 Chen
2011/0284045 A1 11/2011 Reeb
2011/0308559 A1* 12/2011 Ma et al. ..... 135/122
2012/0006373 A1 1/2012 Stehly
2012/0034023 A1 2/2012 Wang et al.
2012/0107037 A1 5/2012 Huang
2012/0146354 A1 6/2012 Lofley, Sr. et al.
2012/0175917 A1 7/2012 Chen
2012/0305042 A1 12/2012 Lorbiecki
2013/0069400 A1 3/2013 Nikolic
2013/0247948 A1 9/2013 Lovley, II et al.
2013/0284225 A1* 10/2013 Holland et al. ..... 135/139
2014/0158176 A1 6/2014 Lovley, II
2014/0174491 A1* 6/2014 Yang ..... 135/144
2014/0190541 A1 7/2014 Lovley, II et al.
2014/0283891 A1 9/2014 Lovley, II et al.
2014/0306494 A1 10/2014 Frankel et al.
2015/0252587 A1 9/2015 Lovley, II
2015/0345172 A1 12/2015 Lovley, II

FOREIGN PATENT DOCUMENTS

CN 1104546 4/2003
CN 2705649 6/2005
CN 2880991 3/2007
CN 201216348 Y 4/2009
CN 102022609 A 4/2011
CN 202055611 11/2011
CN 202706662 U 1/2013
CN 2545298 4/2013
DE 26 55 028 A1 6/1978
DE 31 31 166 A1 2/1983
DE 35 360 49 A1 4/1987
DE 42 01 743 A1 10/1992
DE 10 2010 049 941 5/2012
DE 102010049941 5/2012
EP 564326 10/1993
FR 532496 2/1922
FR 2 691 619 12/1993
FR 2805559 A1 * 8/2001 ..... E04H 15/50
GB 2 052 960 2/1981
GB 2 091 648 8/1982
GB 2 216 850 10/1989
JP 58-129855 9/1983
JP 61-7351 1/1986
JP 7 207 962 8/1995
JP 3059720 7/2000
JP 2001-003604 1/2001
JP 2001-254535 9/2001
JP 2002-209663 7/2002
JP 2005-290837 10/2005
JP 2011-144606 7/2011
KR 10-2004-0023115 3/2004
KR 20060001341 1/2006
KR 100886118 2/2009
KR 20110054253 5/2011
KR 10-2002-0048191 6/2012
KR 10-2014-0135004 11/2014
SU 1174551 8/1985
WO WO 82/01984 6/1982
WO WO 91/14386 10/1991

(56) References Cited

FOREIGN PATENT DOCUMENTS

| | | |
|---|---|---|
| WO | WO 94/23162 | 10/1994 |
| WO | WO 96/39066 | 12/1996 |
| WO | WO 2005/024158 | 3/2005 |
| WO | WO 2007/018926 | 2/2007 |

* cited by examiner

CANOPY WITH OVERHANG

INCORPORATION BY REFERENCE TO RELATED APPLICATIONS

Any and all applications identified in a priority claim in the Application Data Sheet, or any correction thereto, are hereby incorporated by reference herein and made a part of the present disclosure.

BACKGROUND

Field

Embodiments relate to a canopy having an overhang portion. In particular, embodiments relate to a collapsible canopy assembly having a frame assembly incorporating overhang and other frame members and attachment of a cover to the frame assembly.

Description of Related Art

Collapsible canopies are often used in residential and commercial applications to provide shade or protection from the elements with a quick and easy to set-up arrangement. While improvements have been made to the early collapsible canopy designs, a need still exists for further improvements and refinements. For example, it can be desirable to provide increased protection or coverage of the canopy for a given footprint. In addition, it can be desirable to provide collapsible canopies having an improved or more refined appearance.

SUMMARY

The systems, methods and devices described herein have innovative aspects, no single one of which is indispensable or solely responsible for their desirable attributes. Without limiting the scope of the claims, some of the advantageous features will now be summarized.

An embodiment involves a collapsible canopy including a frame assembly comprising a perimeter frame portion and an overhang frame portion. A cover is secured to the frame assembly, the cover comprising a central portion and an overhang portion. The overhang portion is located at least partially outside of the perimeter frame portion. The overhang frame portion is automatically moved between a collapsed position and a deployed position in response to movement of the perimeter frame portion between a collapsed position and a deployed position.

In some configurations, the cover is secured to the overhang frame portion in the collapsed position of the overhang frame portion. In some configurations, the overhang frame portion comprises a main overhang member, and wherein the cover comprises a pocket which receives an end portion of the main overhang member. In some configurations, the frame assembly further comprises a central frame portion, wherein the main overhang member is oriented at an angle that is substantially the same as an angle of the central portion of the cover that is supported by the central frame portion. In some configurations, the overhang frame portion further comprises a strut extending between the main overhang member and one or more of the perimeter frame portion, the central frame portion and a leg of the frame assembly. In some configurations, a slider is movable relative to the leg of the frame assembly and carrying portions of one or both of the perimeter frame portion and the central frame portion, wherein the strut is connected to the slider.

In some configurations, the cover further comprises portions that engage the overhang frame portions. In some configurations, a fastener couples the portions of the cover and the overhang frame portions. In some configurations, the portions comprise pockets that each receives a member of an associated one of the overhang frame portions. In some configurations, a fastener couples the pocket and the overhang frame portions.

An embodiment involves a collapsible canopy including a frame assembly, comprising a plurality of legs, a perimeter frame portion extending between and connecting the plurality of legs to define a perimeter of the collapsible canopy, wherein each section of the perimeter frame portion between adjacent legs includes a plurality of straight frame members oriented substantially perpendicular to the legs. A central frame portion extends between and connects the plurality of legs within the perimeter of the collapsible canopy. The central frame portion includes a plurality of scissor-frames. An overhang frame portion includes a main overhang frame member and an overhang strut extending outwardly from each of the plurality of legs. The perimeter frame portion, the central frame portion and the overhang frame portion are coupled to each of the plurality of legs by a fixed bracket and a sliding bracket, wherein movement of the sliding bracket moves the perimeter frame portion, the central frame portion and the overhang frame portion between a collapsed orientation and a deployed orientation. A cover is secured to the frame assembly. The cover comprises a central portion and an overhang portion, wherein the central portion is supported by the central frame portion and the overhang portion is located at least partially outside of the perimeter frame portion and is supported by the overhang frame portion.

In some configurations, each of the plurality of legs are adjustable in height. In some configurations, the cover is secured to the overhang frame portion in the collapsed position of the overhang frame portion. In some configurations, the cover comprises a pocket which receives an end portion of the main overhang member.

An embodiment involves a collapsible canopy, comprising a frame assembly comprising a plurality of legs, a perimeter frame portion and a central frame portion. The central frame portion comprises a center support. A cover is secured to the frame assembly. The central frame portion comprises at least one central frame section that extends between one of the plurality of legs and the center support, wherein the frame section crosses from one side to another of a line between a center of the one of the plurality of legs and a center of the center support.

In some configurations, the at least one central frame section comprises a plurality of central frame sections, each of the central frame sections extending between each of the plurality of legs and the center support. In some configurations, an overhang frame portion extends outwardly from each of the plurality of legs, wherein the cover comprises an overhang portion coupled to the overhang frame portion. In some configurations, the overhang frame portion is automatically moved between a collapsed position and a deployed position in response to movement of the perimeter frame portion and the center frame portion between a collapsed position and a deployed position.

An embodiment involves an underside of a bottom portion of a structural member, such as an underside of a foot of a canopy leg or the like. The underside of the bottom portion of the structural member can comprise an outer perimeter portion, a hollow interior portion at least partially within the outer perimeter portion, and a logo or design portion at least partially within the hollow interior portion. The logo portion can comprise a three-dimensional structure, wherein a perimeter of the logo portion is adjacent to the hollow interior portion. Preferably, the logo portion can be formed in a reversed orientation, such that the combination of the outer perimeter portion, hollow interior portion, and logo portion of the bottom portion of the foot is configured to leave an impression of the logo portion on a ground surface that is in a forward, not reversed, orientation. However, in other arrangements, the logo portion may not be reversed.

In some arrangements, the logo portion comprises text. The text of the logo portion can be formed in a reversed orientation, such that the bottom portion of the foot is configured to leave an impression of the text on a ground surface that is in a forward legible, not reversed, orientation.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION

Figure 1:
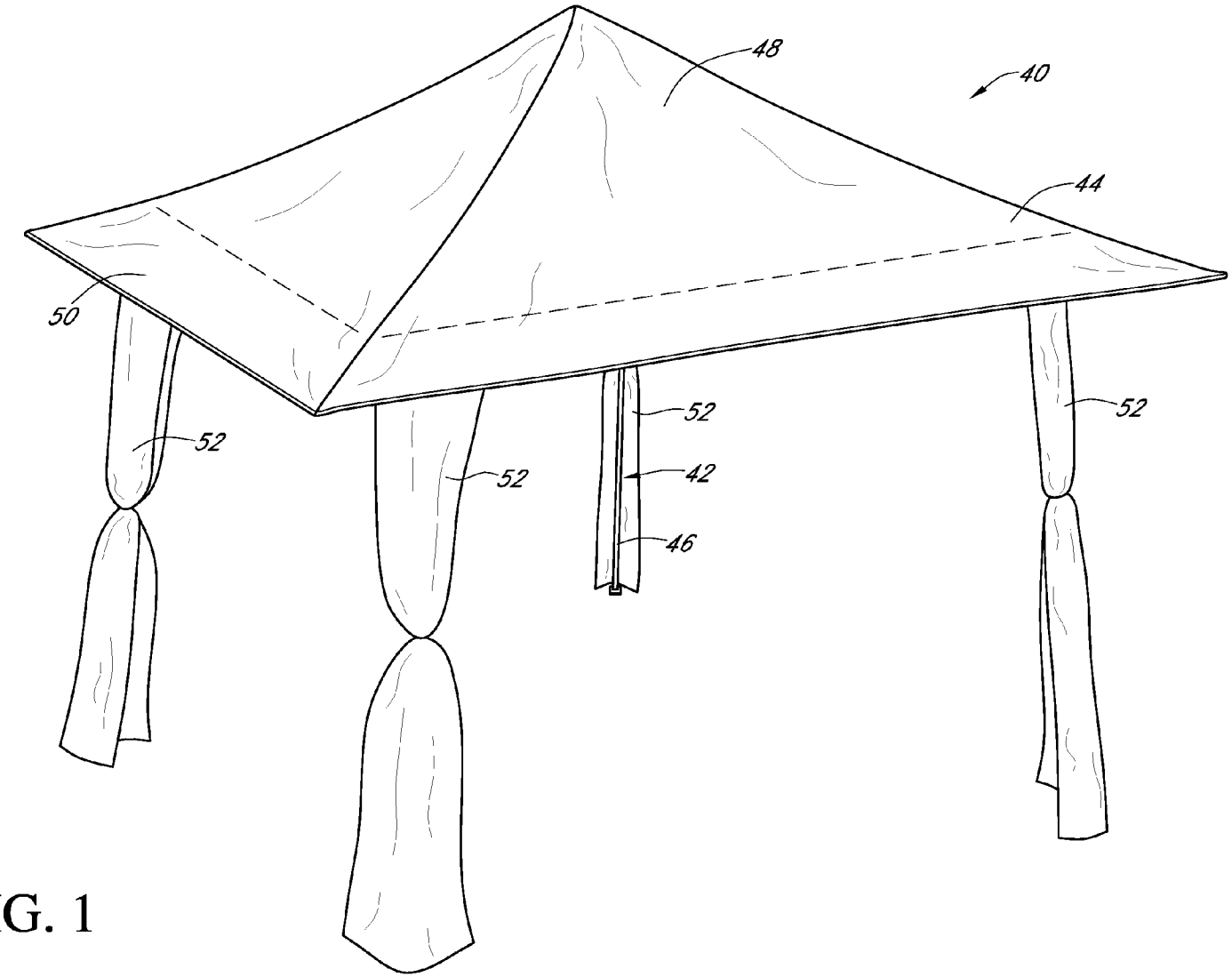
FIG. 1 is a perspective view of a canopy having an overhang portion. The canopy includes a frame assembly and a cover secured to the frame assembly.

Embodiments of canopy systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extend beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

With reference to FIG. 1, a canopy 40 includes a frame assembly or frame 42 and a cover 44. The frame 42 includes a plurality of legs 46 that support the cover 44 above a surface on which the canopy 40 is supported. In the illustrated arrangement, a leg 46 is provided at or near each corner of the canopy 40. In some configurations, additional legs are provided, such as along or near a perimeter of the canopy 40. The cover 44 defines a first or interior portion 48 within a perimeter defined by the legs 46. Preferably, the cover 44 defines a second, exterior or overhang portion 50 outside of the perimeter defined by the legs 46. The overhang portion 50 can provide a desirable appearance to the canopy 40 and/or provide additional shade compared to a canopy having a perimeter of the same size but without an overhang portion. The canopy 40 can also include curtains 52, which preferably can be moved between a stowed orientation (as shown) gathered at the legs 46 and a deployed orientation (not shown) to define partial or full walls between adjacent legs 46.

In the illustrated configuration, the legs 46 are canted or angled such that a lower end of the leg 46 is positioned outwardly from an upper end of the leg 46. The overhang portion 50 can be positioned outside of a perimeter defined by any portion of the legs 46. For example, the overhang portion 50 can be outside of a perimeter defined by upper ends of the legs 46. In some configurations, the overhang portion 50 can extend outside of a perimeter defined by lower ends of the legs 46. In other configurations, the legs 46 can be generally or substantially vertical. Preferably, the legs 46 are collapsible to move at least between a stowed or collapsed position and an expanded or deployed position. The legs 46 can also permit height adjustment between at least two or more possible height positions. For example, the legs 46 can employ a biased pin-and-hole adjustment arrangement or can be infinitely adjustable. An example of an infinitely adjustable arrangement is described in Applicant's U.S. Patent Publication No. 2014/0090681, the entirety of which is hereby incorporated by reference herein.

Figure 2:
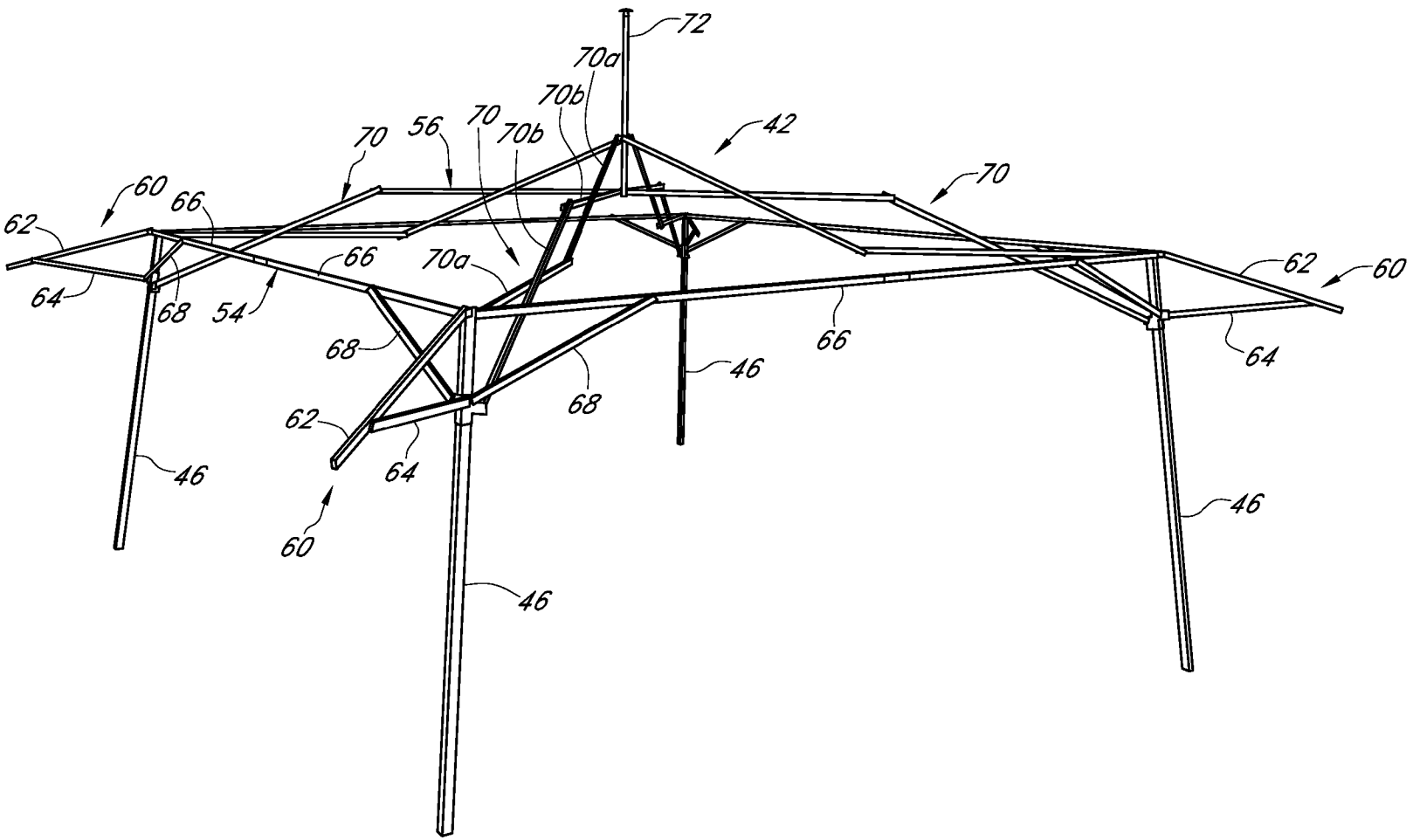
FIG. 2 is a perspective view of the frame assembly of the canopy of FIG. 1. The frame assembly includes several overhang frame portions.
Figure 4:
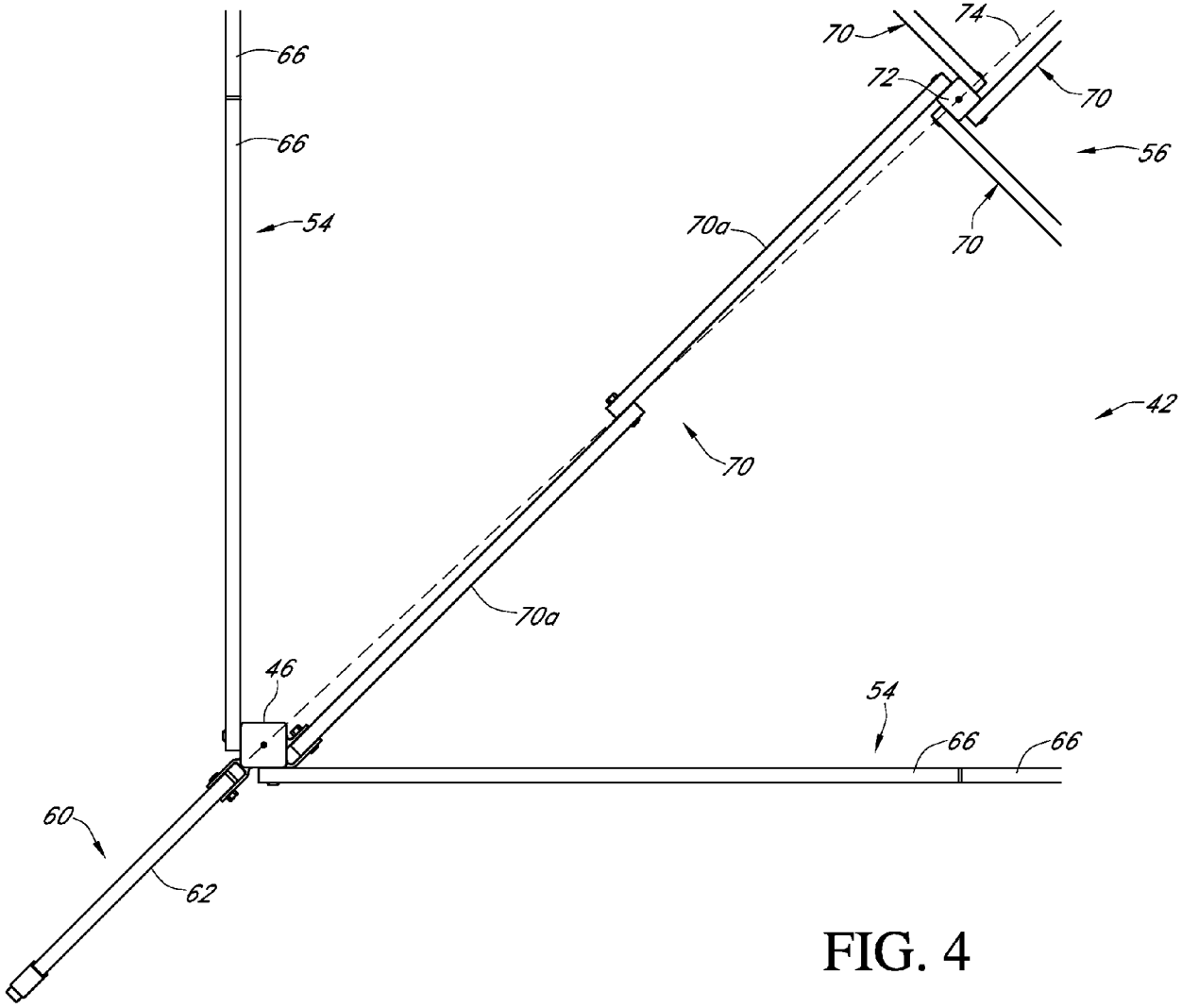
FIG. 4 is a top view of a section of an interior frame portion of the frame assembly of FIG. 2. The illustrated section of the interior frame portion extends from a corner to a center of the frame assembly.
Figure 5:
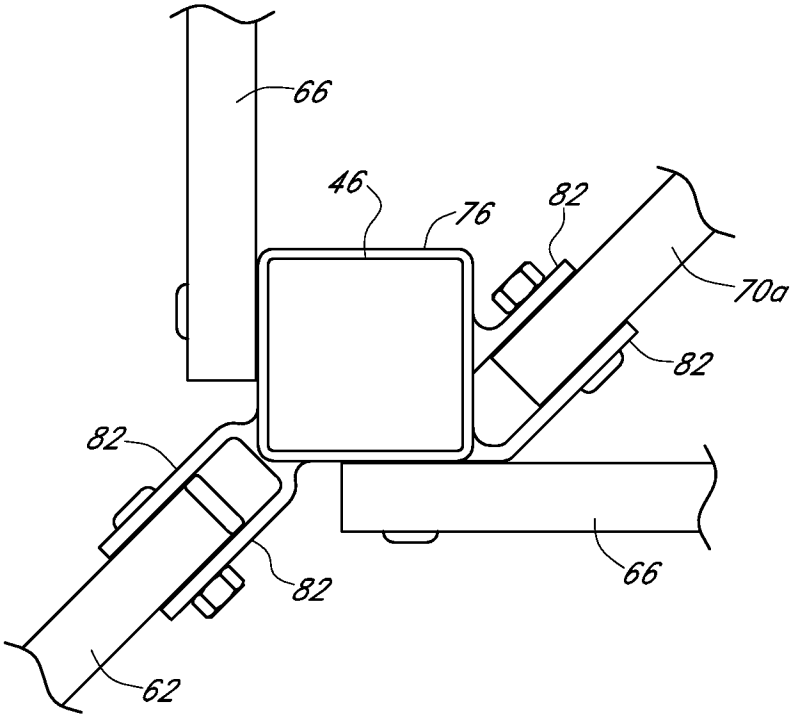
FIG. 5 is a top view of an upper or fixed corner bracket and related frame members of the frame assembly of FIG. 2.
Figure 6:
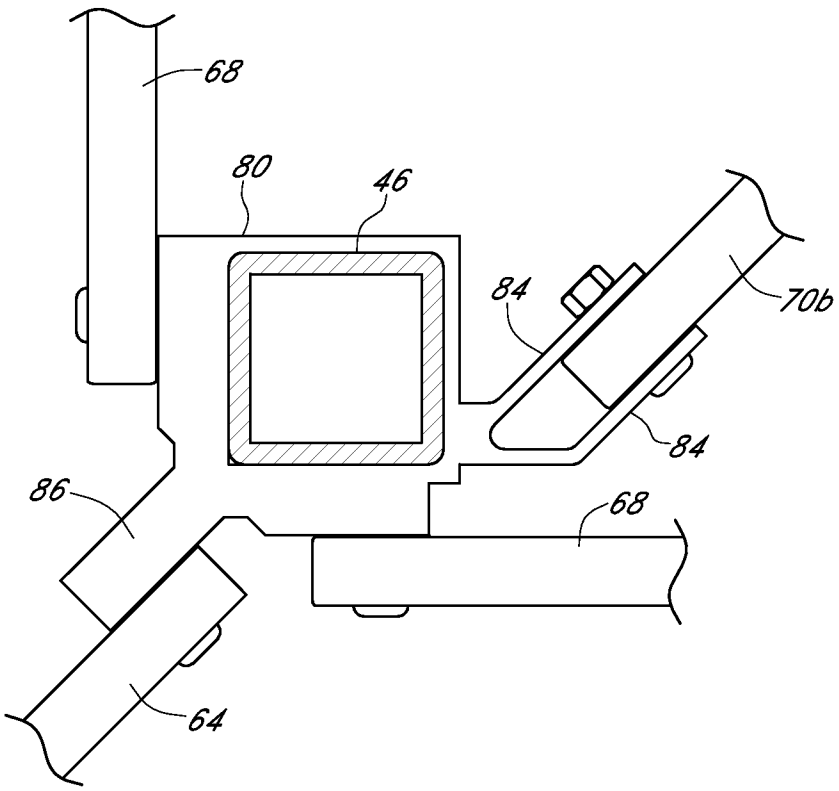
FIG. 6 is a top view of a lower or sliding corner bracket and related frame members of the frame assembly of FIG. 2.

With reference to FIG. 2, the frame 42 has a perimeter frame portion 54 and a central frame portion 56, in addition to the above-described legs 46. Preferably, the frame 42 also includes one or more overhang frame portions 60 comprising one or more overhang frame members, such as a main overhang frame member 62 and an overhang support member, lift member or strut 64. The main overhang frame member 62 can be in the form of an overhang tube and the strut 64 can be in the form of a lift tube. In the illustrated arrangement, an overhang frame portion 60 is provided at each corner of the frame 42 or canopy 50. Each overhang frame portion 60 can extend diagonally from the associated corner of the frame 42, or at approximately a 45 degree angle from each perimeter frame portion 54 extending from the associated corner. In the illustrated configuration, a longitudinal axis of the main overhang frame member 62 passes through a center point of the associated leg 46, as shown in FIGS. 4 and 5. The overhang strut 64 can be offset to one side of the main overhang frame member 62 and coupled to a side of the main overhang frame member 62, as shown in FIG. 6. If desired, additional or alternative overhang frame portions can be provided at locations other than the corners, such as on the perimeter frame portion 54 between the corners, for example and without limitation.

The cover 44 can be a fabric or flexible material cover capable of collapsing along with the preferably collapsible frame 42. The cover 44 can be removable from the frame 42. Preferably, the overhang frame portions 60 support an overhang portion of the cover 44, which extends outwardly from the perimeter frame portion 54. Thus, as described above, the cover 44 can include the central or interior portion 48 located substantially within an area defined by the perimeter frame portion 54 and the overhang portion 50, which surrounds or circumscribes the central portion 48 of the cover 44.

The perimeter frame portion 54 can include sides or eaves that extend between each of the frame legs 46. The perimeter frame portion 54 can be constructed of linear or straight frame members 66 (e.g., horizontal or substantially perpendicular to the legs 46 when extended) that can be folded at one or more points along the length of the frame members 66. In the illustrated arrangement, the frame members 66 are rotatable about a pair of closely-spaced pivot points, which can be defined by a bracket, such that the frame members 66 can fold next to one another when the frame 42 is collapsed. Two frame members 66 are illustrated; however, other numbers of frame members 66 could be employed. Advantageously, the linear or straight arrangement of the frame members 66 of the frame portion 54 along the sides of the canopy 40 reduces the vertical height of the frame to reduce or eliminate the likelihood of a user bumping into the perimeter frame portion 54 when entering or exiting the canopy 40, at least compared to arrangements in which scissor-frames are incorporated in the perimeter frame.

The illustrated perimeter frame portion 54 also includes struts 68 that provide support to the frame members 66. In particular, each strut 68 attaches to the associated leg 46 at a location spaced (e.g., below) from a location of attachment of the frame member 66. Each strut 68 extends to an attachment point with the frame member 66 that is spaced from the leg 46. Each end of the strut 68 is rotatably attached to the frame member 66 or leg 46, directly or indirectly, such as through a bracket (as described below). Preferably, a strut 68 is provided for each frame member 66 of each of the perimeter frame portions 54.

The central frame portion 56 can extend between portions of the perimeter frame portion 54, such as between corners of the frame 42, and support the central portion of the cover 44. In the illustrated arrangement, the central frame portion 56 includes a plurality of struts, trusses or, preferably, scissor-frame arrangements 70 that extend from the corners of the frame 42 and connect to one another at an intermediate location (e.g., center point or center location relative to one or more sides of the canopy 40) within the area defined by the perimeter frame portion 54. In the illustrated arrangement, the scissor-frames 70 connect to a center support 72 (which could be an interior support or one of multiple interior supports in embodiments in which the support 72 is not centrally located and/or in which multiple supports are provided). The center support 72 can be configured to extend above the scissor-frames 70 when the canopy frame 42 is deployed and can retract to approximately the tops of the scissor-frames 70 when the canopy frame 42 is collapsed to provide a compact collapsed arrangement.

With reference to FIG. 4, preferably, each of the scissor-frames 70 cross from one side to the other side of a line 74 passing through centers of the associated leg 46 and the center support 72. In FIG. 4, only the arms 70*a* of the scissor-frame 70 coupled to an upper portion (relative to the other arm 70*b*) of the leg 46 and to an upper portion (relative to the other arm 70*b*) of the center support 72 are shown. As is apparent from at least FIGS. 2, 5 and 6, the other arms 70*b* of the scissor-frame 70 are offset to one side of the arms 70*a*. In at least some configurations, the arms 70*b* also cross from one side to the other side of the line 74. In the illustrated arrangement, one end of the scissor-frame 70 is coupled to a side or other portion of the leg 46 and to a side or other portion of the center support 72 on the opposite side of the line 74. Additional details of a similar frame (not including the overhang frame portions 60 or arms 70 that cross the line 74) are described in Applicant's U.S. Patent Publication No. 2013/0247948, the entirety of which is incorporated by reference herein.

Figure 3:
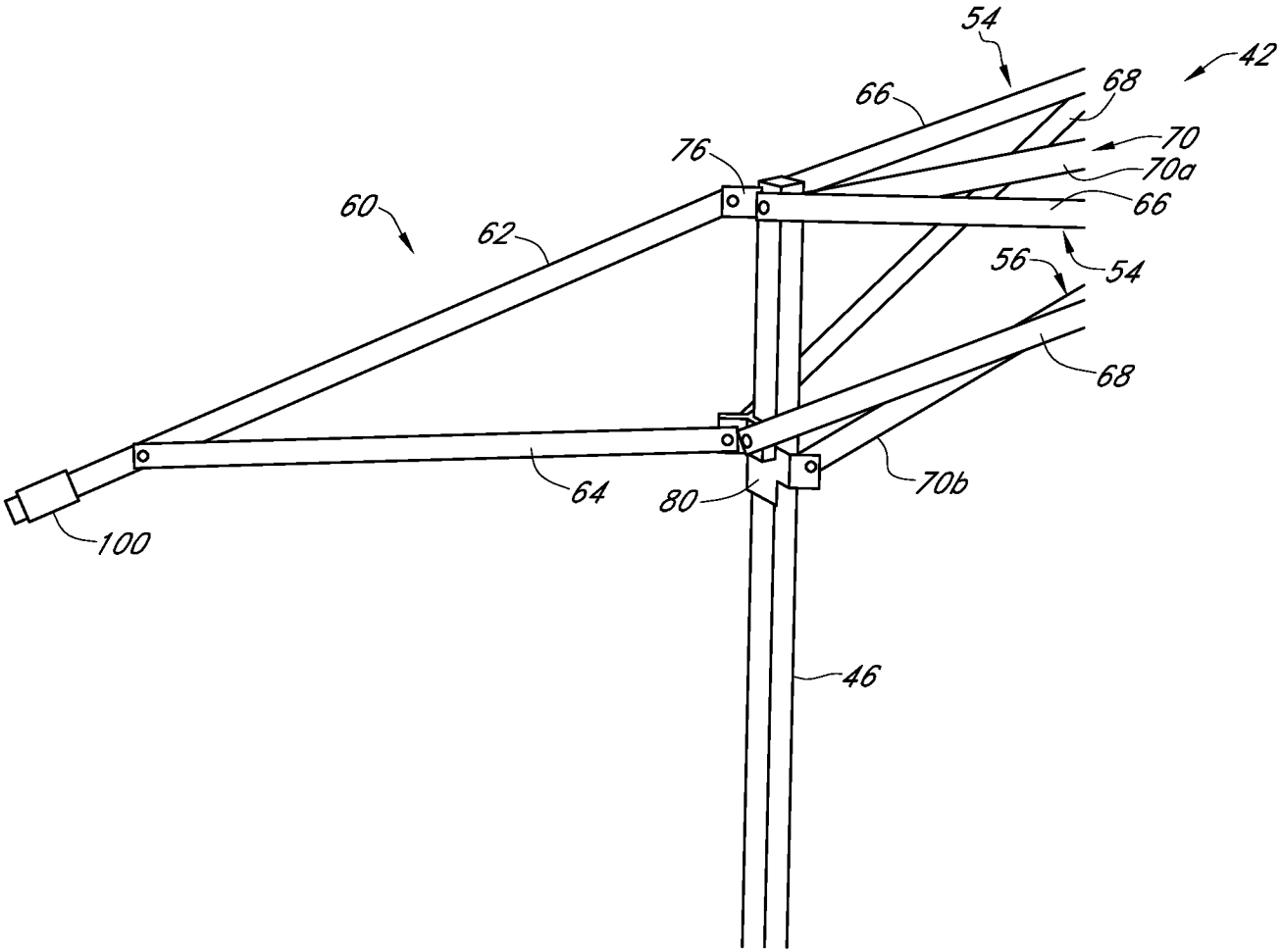
FIG. 3 is a perspective view of a corner of the frame assembly of FIG. 2 illustrating an overhang frame portion.

With reference to FIGS. 2-4, preferably, the main overhang member 62 of each overhang frame portion 60 is secured to an upper portion, such as an upper corner, of the associated frame leg 46 and extends downwardly therefrom. In the illustrated arrangement, the main overhang member 62 is coupled to a top support member or top bracket 76 of the frame leg 46, preferably near connection points for one or both of the perimeter frame portion 54 and central frame portion 56. The main overhang member 62 can extend downwardly at an angle similar to the angle (or pitch) of the central frame portion 56 such that an angle or pitch of the cover 44 is substantially consistent between the central portion 48 and the overhang portion. Alternatively, the main overhang member 62 can be oriented at a different angle or pitch from the central frame portion 56 to achieve a desired end result (e.g., increased shading). In the illustrated arrangement, the main overhang member 62 is separate from the central frame portion 56; however, in other arrangements, the main overhang member 62 could be unitary with a member or portion of the central frame portion 56.

The strut 64 of the overhang frame portion 60 preferably is positioned below the main overhang member 62 and extends between the main overhang member 62 and the perimeter frame portion 54, central frame portion 56 or leg 46. In the illustrated arrangement, a portion (e.g., end) of the strut 64 is coupled to a slider 80 on the leg 46, which is movable relative to the leg 46. The slider 80 can support other frame portions, such as one or both of the perimeter frame portion 54 and the central frame portion 56. In the illustrated arrangement, the slider 80 pivotally supports the strut 64 and one or more members of the central frame portion 56 by any suitable arrangement, including one or more tabs that receive a pin, shaft or other type of axle member. The slider 80 and top bracket 76 can be constructed of any suitable material, such as plastic, metal or other materials. In some configurations, the top bracket 76 can be constructed of one material (e.g., metal) and the slider 80 can be constructed from a different material (e.g., plastic).

In an alternative arrangement, the strut 64 or lift tube can be connected to a slider that is separate from the slider 80 or the slider 80 can have portions that are separable from one another so that slider portion coupled to the lift tube or strut 64 can be movable with or separated for independent movement relative to the other portion of the slider 80 that is coupled to other frame members. Such an arrangement would permit the overhang frame portion 60 to be deployed along with deployment of the main frame portion of the canopy 50, but then be separately adjusted to alter an angle or pitch of the overhang portion of the cover 44. Thus, the overhang portion of the cover 44 could be adjusted similar to the adjustable awning disclosed in Applicant's U.S. Pat. No. 7,775,229, the entirety of which is incorporated by reference herein.

Another portion (e.g., end) of the strut 64 is pivotally coupled to an intermediate portion of the main overhang member 62. Preferably, the strut 64 is coupled to the main overhang member 62 at a location beyond the midpoint of the main overhang member 62 or a midpoint between the associated corner and an outer end of the main overhang member 62. The strut 64 can be located beyond at least about two-thirds of the length of the main overhang member 62 from the associated corner or at about three-fourths of the distance between the associated corner and an outer end of the main overhang member 62. Preferably, the overhang frame portions 60 (e.g., both the main overhang member 62 and the strut 64) can pivot, fold or collapse relative to other portions of the frame 42 to permit the canopy 50 to be oriented in a collapsed state for transport or storage. In the illustrated arrangement, the overhang frame portions 60 (e.g., both the main overhang member 62 and the strut 64) fold (e.g., downwardly) against (or substantially parallel to) the adjacent leg 46. As described above, the main overhang member 62 is pivotally supported by the top bracket 76 and the strut 64 is pivotally supported by the slider 80. Such an arrangement advantageously permits automatic and preferably substantially simultaneous deployment and collapse of the overhang frame portions 60 along with deployment and collapse of the main frame portion of the canopy 50.

FIGS. 5 and 6 illustrate the top bracket 76 and slider 80, respectively. As described, the top bracket 76 can be attached to an upper end or upper portion (at least with respect to the slider 80) of the leg 46 and can rotatably support frame members relative to the leg 46, such as the straight frame members 66 of the perimeter frame portion 54, the arm 70*a* of the scissor-frame 70 and the main overhang frame member 62. The frame members can be rotatably coupled to the top bracket 76 by any suitable arrangement, such as a bolt-and-nut, pin or other type of shaft, for example and without limitation.

The straight frame members 66 can be aligned with the sides of the leg 46. The main overhang frame member 62 can extend diagonally outward from an outer corner of the leg 46. As described above, the arm 70*a* can extend inwardly and at least a longitudinal axis of the arm 70*a* can be offset to one side of a center of the leg 46. Preferably, the top bracket 76 includes generally U-shaped bracket portions having tabs 82 that support each side of one or both of the arm 70*a* of the scissor-frame 70 and the main overhang frame member 62. If desired, the top bracket 76 could also support each side of the straight frame members 66 of the perimeter frame portion 54.

Each of the sliders 80 preferably are movable along each of the legs 46 to allow the frame 42 to move between a collapsed orientation and a deployed orientation. The slider 80 can be secured in one or both of the collapsed or deployed positions by any suitable arrangement. In the illustrated configuration, the slider 80 is secured in the deployed orientation by a lock, such as a biased pin-and-hole arrangement, for example and without limitation.

The slider 80 can be configured to rotatably support frame members relative to the leg 76 in a manner similar to the top bracket 76. The frame members can be rotatably coupled to the slider 80 by any suitable arrangement, such as a bolt-and-nut, pin or other type of shaft, for example and without limitation. In the illustrated arrangement, the slider 80 supports the struts 68 of the perimeter frame portions 54, the arms 70*b* of the central frame portion 56 and the overhang strut 64.

Preferably, the slider 80 supports these frame members in an orientation corresponding to, but offset from, the associated frame members of the top bracket 78 such that the frame members will be appropriately positioned relative to one another. For example, the perimeter struts 68 are spaced from the sides of the leg 46 by approximately the width of the straight frame members 66 of the perimeter frame portion 54 such that the perimeter struts 68 are positioned to the outside of the straight frame members 66 of the perimeter frame portion 54. Similarly, the arms 70*b* are positioned to the side (e.g., away from the center of the leg 46 and/or line 74) of the arms 70*a* and the overhang strut 64 is positioned to the side (e.g., away from the center of the leg 46 and/or line 74) of the main overhang frame member 62.

In the illustrated arrangement, the slider 80 includes a generally U-shaped bracket portion having tabs 84 that support each side of the arm 70*b* of the scissor-frame 70. If desired, the top bracket 76 could also support each side of the perimeter strut 68 and/or the overhang strut 64. However, in the illustrated arrangement, the slider 80 includes a tab 86 that supports one side of the overhang strut 64. Preferably, the tab 86 has a width that is substantially equal to a width of the overhang strut 64 and/or the main overhang frame member 62 or is otherwise configured to provide suitable resistance to rotation of the overhang strut 64 about its longitudinal axis.

Figure 7:
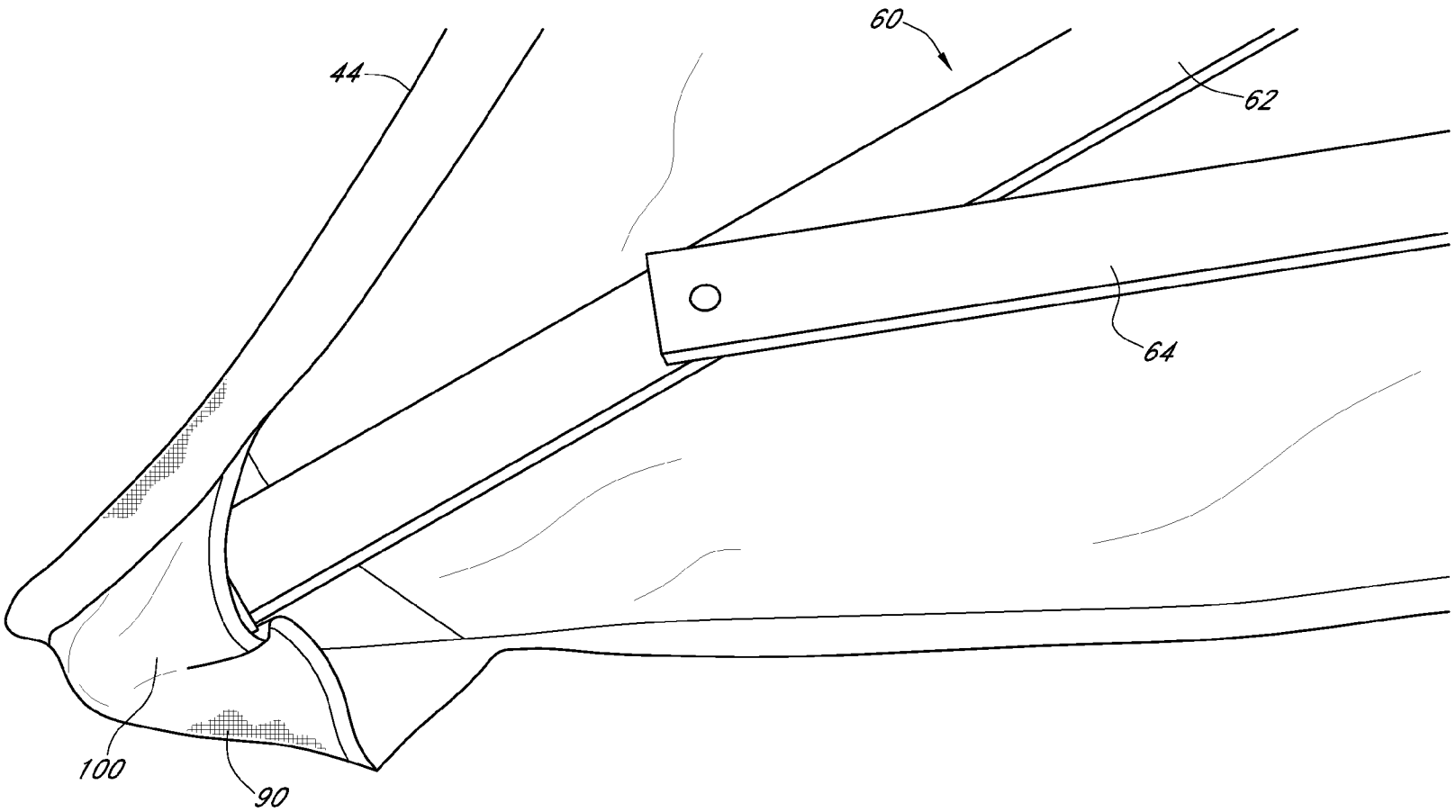
FIG. 7 is a perspective view of a corner of the canopy illustrating a coupling of the cover to the overhang frame portion.

With reference to FIGS. 1 and 7, the cover 44 is coupled to the overhang frame portions 60 such that the cover 44 remains coupled to the overhang frame portions 60 when the canopy 50 is collapsed. In the illustrated arrangement, corners of the cover 44 are coupled to end portions of the overhang frame portions 60, in particular the end portion of the main overhang member 62. The cover 44 can be coupled to the overhang frame portions 60 by any suitable arrangement, such as a retention member or arrangement on the cover 44 that engages a portion of the overhang frame portions 60. In the illustrated arrangement, the corner portions of the cover 44 include a pocket 90 that is configured to receive an end portion of the main overhang member 62. The pocket 90 can be constructed of the same material as the cover 44 and can include a folded portion of the cover 44. In other words, the portion of the cover 44 defining the pocket 90 can be unitary with at least a portion of the cover 44 defining areas other than the pocket 90 and, preferably, at least portions of the overhang portion and/or the central portion. Alternatively, the pocket 90 can be defined, at least partially, by a separate piece of material coupled (e.g., sewn) to the cover 44.

In the illustrated arrangement, the pocket 90 defines a closed end such that an end portion of the main overhang member 62 contacts the closed end of the pocket 90. Thus, tension of the cover 44 may provide a sufficient retention force to retain the cover 44 onto the overhang frame portion 60 or may be sufficient to be the only means of retention of the cover 44 onto the frame 42. However, supplemental coupling of the cover 44 to the frame 42 could also be provided, such as straps, for example. The pocket 90 (or any other portion of the cover 44) could include a fastener assembly 100 to secure or assist in securing the cover 44 to the overhang frame portion 60. Any suitable fastener assembly 100 can be used, such as mechanical, friction-fit, snap-fit fasteners or others. In the illustrated arrangement, the fastener assembly 100 is a removable fastener (in particular, a hook-and-loop fastener) having a portion associated with the cover 44 and a portion associated with the overhang frame portion 60. In particular, one portion of the fastener assembly 100 is positioned within the pocket 90 and the other portion of the fastener assembly 100 is located on a portion of the overhang frame portion 60 that engages the pocket 90. The portion of the hook-and-loop fastener 100 on the main overhang member 62 can be wrapped around an entire circumference or periphery of the main overhang member 62. The portion of the hook-and-loop fastener 100 on the pocket 90 can be a longitudinal strip. In other arrangements, the pocket 90 can be entirely lined, or substantially entirely lined, with the portion of the hook-and-loop fastener 100.

Figure 8:
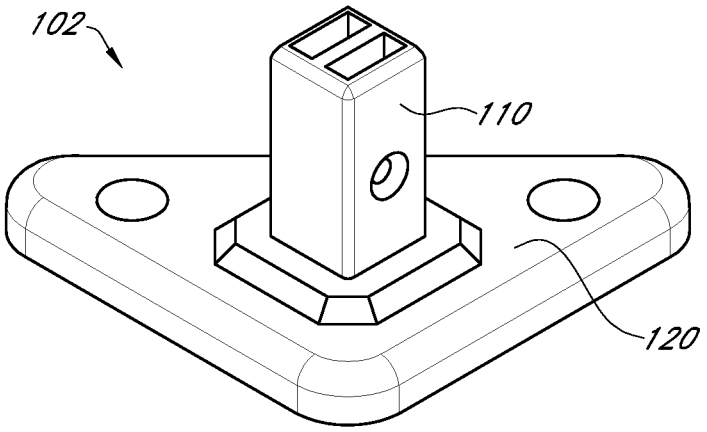
FIG. 8 is a perspective view of a top-side of a bottom portion of a structural member of an embodiment of the wheel cover.
Figure 9:
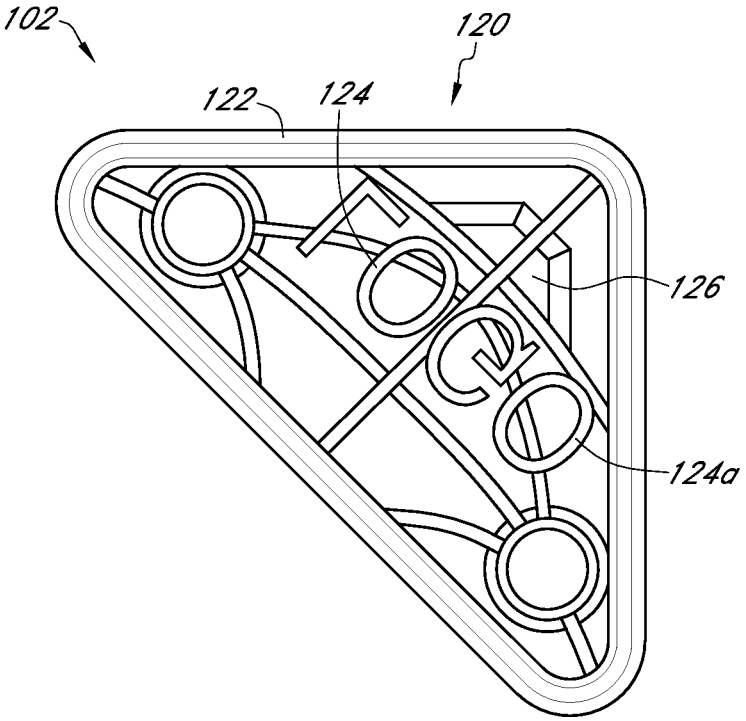
FIG. 9 is a bottom plan view of an underside of the bottom portion of the structural member of FIG. 8.
Figure 10:
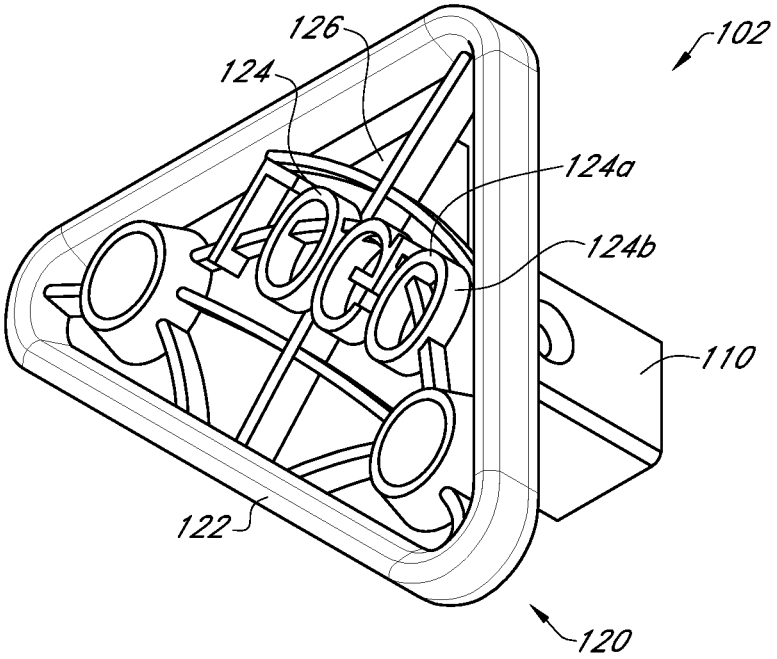
FIG. 10 is a perspective view of the underside of the bottom portion of the structural member of FIG. 8.

FIGS. 8-10 illustrate an embodiment of a bottom portion 102 of a structural member (not shown), which can be a foot of a canopy leg or the like. As shown in FIG. 8, which illustrates a top side of the bottom portion 102, the bottom portion 102 can comprise a base portion 120 and a connector portion 110. For example, the base portion 120 can be configured to have a surface area wide enough to provide stability to a structural member, such as a canopy leg. The connector portion 110 can be configured to couple to the structural member. In other embodiments, the connector portion 110 can comprise the structural member and extend further upward. The bottom portion 102, including the base portion 120, can comprise plastic, metal, rubber, or any other suitable material. In preferred embodiments, the base portion 120 can comprise plastic.

FIGS. 9 and 10 illustrate an underside of the bottom portion 102 of a structural member (not shown). The base portion 120 can comprise an outer perimeter portion 122, a logo portion 124, and a hollow interior portion 126. For example, the hollow interior portion 126 can be located at least partially within the outer perimeter portion 122, and the logo portion 124 can be at least partially within the hollow interior portion 126. The hollow interior portion can comprise a depth that is limited by the size of the base portion 120. In some embodiments, the hollow interior portion 126 can have a depth of, for example, approximately 2-3 mm. In other configurations, the depth can be smaller or larger. The logo portion 124 can comprise a three-dimensional structure, wherein a perimeter of the logo portion 124 is adjacent to the hollow interior portion 126. For example, the logo portion 124 can comprise a bottom surface area 124*a* that is substantially parallel to a horizontal direction of the base portion 120. The logo portion 124 can comprise a side surface area 124*b* that is generally or substantially perpendicular to a horizontal direction of the base portion 120 and which is adjacent to the hollow interior portion 126. The term "logo" is used herein in accordance with its ordinary meaning. Thus, the term is intended to cover text, symbols or a combination of the two. The word "logo" is used in the drawings in an exemplary fashion. It is intended that an actual word mark and/or symbol will be used. The actual "logo" can be of the company that markets the canopy or of the end user, in the situation of a commercial use, for example. In other embodiments, the logo portion 124 can comprise any other design, including any other text, patterns, graphics, objects and structures. Thus, references or descriptions in the present disclosure relating to "logos" can equally apply to other designs, as well.

When the bottom portion 120 is used to support a structural member on a ground surface, the bottom portion 120 can be configured to leave an impression or stamp of the logo portion 124 on the ground surface. For example, the ground surface can comprise dirt, mud, sand, grass, as well as any other surface capable of receiving an imprint. When the bottom portion 120 is used to support a structural member on the ground surface, portions of the ground surface can rise to at least partially fill the hollow interior portion 126, whereas the logo portion 124 prevents portions of the ground surface from occupying its space. Accordingly, when the structural member is moved, which can be used to support a portable canopy structure, a visible indentation of the logo portion 124 may remain on the ground surface.

In alternative embodiments, the logo portion 124 may comprise a hollow interior, whereas the interior portion 126 may be filled in. For example, in these embodiments, when the bottom portion 120 is used to support a structural member on the ground surface, portions of the ground surface can rise to at least partially fill the logo portion 124. These embodiments also may result in a visible indication of the logo portion 124 resulting on the ground surface, but the logo would be raised, rather than indented.

Preferably, the logo portion 124 can be formed in a reverse orientation, such that the bottom portion 102 is configured to leave an impression of the logo portion 124 on a ground surface that is in a forward, not reverse, orientation. For example, as illustrated in FIGS. 2 and 3, the logo portion 124 comprises the text "LOGO" written in reverse, such that the bottom portion 102 is configured to leave an indentation of the text "LOGO" on a ground surface that is legible. In other embodiments, the logo portion 124 can comprise the mark EZUP®, or text that spells any other word or trademark and/or any other symbol. In other embodiments, the logo portion 124 can comprise any other recognizable pattern.

In some arrangements, the logo portion comprises text. The text of the logo portion can be formed in a reversed orientation, such that the bottom portion of the foot is configured to leave an impression of the text on a ground surface that is in a forward legible, not reversed, orientation.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A collapsible canopy, comprising:

a frame assembly comprising a perimeter frame portion, an overhang frame portion and a plurality of legs;

wherein the perimeter frame portion comprises four sides, each side of the perimeter frame portion comprising a single member extending between adjacent legs, wherein the single member is foldable and has a straight orientation when the perimeter frame portion is in a deployed orientation;

wherein the overhang frame portion comprises a main overhang member and an overhang strut;

a cover secured to the frame assembly, the cover comprising a central portion and an overhang portion, wherein the overhang portion is located at least partially outside of the perimeter frame portion;

wherein each of the legs is coupled to the perimeter frame portion and the overhang frame portion;

a fixed bracket is fixedly mounted along a top of each of the legs, wherein each fixed bracket is coupled to two adjacent single members of the perimeter frame portion and each of the main overhang members; and a slider positioned around each leg and slidably movable along said leg, wherein the slider is coupled to the overhang strut and two perimeter frame struts, each perimeter frame strut coupling the slider to an adjacent single member of the perimeter frame portion;

wherein movement of the slider is configured to simultaneously move the perimeter frame portion and the overhang frame portion between a collapsed orientation and the deployed orientation.

2. The collapsible canopy of claim 1, wherein the cover is secured to the overhang frame portion in the collapsed position of the overhang frame portion.

3. The collapsible canopy of claim 2, wherein the cover comprises a pocket which receives an end portion of the main overhang member.

4. The collapsible canopy of claim 1, wherein the frame assembly further comprises a central frame portion, wherein the main overhang member is oriented at an angle that is substantially the same as an angle of the central portion of the cover that is supported by the central frame portion.

5. The collapsible canopy of claim 1, wherein the cover further comprises portions that engage the overhang frame portions.

6. The collapsible canopy of claim 5, further comprising a fastener that couples the portions of the cover and the overhang frame portions.

7. The collapsible canopy of claim 5, wherein the portions comprise pockets that each receives a member of an associated one of the overhang frame portions.

8. The collapsible canopy of claim 7, further comprising a fastener that couples the pocket and the overhang frame portions.

9. A collapsible canopy of claim 1, wherein each of said legs comprises a base, each base comprising:

an outer perimeter portion;

a hollow interior portion at least partially within the outer perimeter portion; and a logo portion at least partially within the hollow interior portion, the logo portion formed in a reverse orientation;

wherein the base is configured to leave an impression of the logo portion on a ground surface that is in a forward, not reverse, orientation; and wherein collapsible canopy is configured to simultaneously create a plurality of impressions of the logo portion on a ground surface underneath each base.

10. The collapsible canopy of claim 1, wherein the frame assembly further comprises a central frame portion, wherein each of the sliders is coupled to the central frame portion.

11. A collapsible canopy, comprising:

a frame assembly, comprising:

a plurality of legs;

a perimeter frame portion extending between and connecting the plurality of legs to define a perimeter of the collapsible canopy, wherein each section of the perimeter frame portion between adjacent legs includes a single frame member oriented substantially perpendicular to the legs and extending between adjacent legs, wherein the single frame member is fixedly coupled to a fixed bracket positioned along a top of each adjacent leg, wherein the single frame member is foldable and has a straight orientation when the perimeter frame portion is in a deployed orientation;

two perimeter struts coupled to a sliding bracket, the sliding bracket positioned below the fixed bracket on each leg, wherein each of the perimeter struts extends between the sliding bracket and an adjacent straight frame member;

wherein the sliding bracket is configured to move relative to the fixed bracket along said leg;

a central frame portion extending between and connecting the plurality of legs within the perimeter of the collapsible canopy, the central frame portion comprising a plurality of scissor-frames; and an overhang frame portion comprising a main overhang frame member and an overhang strut extending outwardly from each of the plurality of legs;

wherein the perimeter frame portion, the central frame portion and the overhang frame portion are coupled to each of the plurality of legs by the fixed bracket and the sliding bracket, wherein movement of the sliding bracket moves the perimeter frame portion, the central frame portion and the overhang frame portion between a collapsed orientation and a deployed orientation; and a cover secured to the frame assembly, the cover comprising a central portion and an overhang portion, wherein the central portion is supported by the central frame portion and the overhang portion is located at least partially outside of the perimeter frame portion and is supported by the overhang frame portion.

12. The collapsible canopy of claim 11, wherein each of the plurality of legs are adjustable in height.

13. The collapsible canopy of claim 11, wherein the cover is secured to the overhang frame portion in the collapsed position of the overhang frame portion.

14. The collapsible canopy of claim 11, wherein the cover comprises a pocket which receives an end portion of the main overhang member.

15. A collapsible canopy, comprising:

a frame assembly comprising a plurality of legs, a perimeter frame portion, a central frame portion and an overhang frame portion; and wherein the central frame portion coupled to the plurality of legs;

wherein the overhang frame portion comprises a main overhang member and an overhang strut being coupled to each leg, the main overhang member having a first end coupled to a top of the leg;

a cover secured to the frame assembly, wherein the cover extends and is secured to a second end of each main overhang member;

wherein the perimeter frame portion comprises a single frame member coupled to the tops of adjacent legs and two perimeter struts each coupled to a slider on each of the legs and to each adjacent single frame members respectively, the single frame member being foldable and having a straight orientation extending between the tops of adjacent legs when the perimeter frame portion is in a deployed orientation; and wherein the overhang strut each coupled to the slider of the leg the main overhang member, and wherein the second end of each main overhang member is angularly lower than both the single frame members and the top of each leg when the overhang frame portion is in a deployed orientation to create a vertical clearance between a peripheral edge of the cover and the adjacent single frame member along each side of the collapsible canopy.

16. The collapsible canopy of claim 15, wherein the central frame comprises at least one central frame section, wherein the at least one central frame section comprises a plurality of central frame sections, each of the central frame sections extending between each of the plurality of legs and a center support.

17. The collapsible canopy of claim 15, wherein the overhang frame portion is automatically moved between a collapsed position and a deployed position in response to movement of the perimeter frame portion and the center frame portion between a collapsed position and a deployed position.

* * * * *